US005208573A

United States Patent [19]

Nagaoka

[11] Patent Number: 5,208,573

[45] Date of Patent: May 4, 1993

[54] ELECTRICAL COIL UNIT

[75] Inventor: Akihiro Nagaoka, Osaka, Japan

[73] Assignee: Diamond Electric Mfg. Co., Ltd., Japan

[21] Appl. No.: 841,505

[22] Filed: Feb. 26, 1992

[30] Foreign Application Priority Data

Oct. 4, 1991 [JP] Japan ..... 3-89616[U]

[51] Int. Cl.[5] ..... H01F 15/10

[52] U.S. Cl. ..... 336/192; 336/208

[58] Field of Search ..... 336/192, 198; 335/208, 335/282, 299; 310/71

[56] References Cited

U.S. PATENT DOCUMENTS 4,701,735 10/1987 Hill et al. ..... 336/208

*Primary Examiner*—Thomas J. Kozma

*Attorney, Agent, or Firm*—Bacon & Thomas

[57] ABSTRACT

An electrical coil unit has a bobbin which includes two flanges, and a winding portion between the flanges, on which a coil winding is wound, and beside at least one of the two flanges, another flange is provided to form an auxiliary winding portion, and removal of the insulating film from the leader extended from the winding starting or finishing end of the coil winding is subjected in the region of the auxiliary winding portion. Thereby, the bare end portions of the leaders of the coil winding are prevented from going into the region of a winding portion of a bobbin.

6 Claims, 1 Drawing Sheet

PRIOR ART

ELECTRICAL COIL UNIT

BACKGROUND OF THE INVENTION

1. Field of the Industrial Application

This invention relates to an electrical coil unit which is formed by winding a conductor on a bobbin of resin.

2. Description of the Prior Art

A conventional electrical coil unit, as shown in FIG. 2, comprises: a bobbin 1 in the form of a cylinder or rectangular parallelepiped which is made of non-magnetic material such as resin; two flanges 3 on both sides of the winding portion 7 of the bobbin 1; and a coil winding 5 wound on the winding portion 7 between the flanges 3. Two end portions of the coil winding 5, namely, the two leaders are extended through one or both of the flanges 3. The leaders 10 have the end portions 12 of a predetermined length, respectively, from which the insulating film is removed (hereinafter referred to as "bare end portions 12", when applicable). More specifically, the bare end portion 12 of each of the leaders 10 is formed by starting the removal of the insulating film from the point on the leader 10 which is at a predetermined distance from the region of the winding portion 7. The bare end portions 12 are connected to input and output terminals.

The coil unit is manufactured for instance as follows: The insulating film is stripped from the leader 10 extended from the winding starting end of the coil winding 5, to provide one of the bare end portions 12. Thereafter, the coil winding 5 is wound on the winding portion 7 of the bobbin. The leaders of the coil winding 5 are extended through the flange or flanges 3. Under this condition, the insulating film is removed from another leader 10 extended from the winding finishing end of the coil, to provide the other bare end portion 12, and the leader 10 is cut as required.

In the above-described coil unit, the bare end portions 12 are set apart from the flanges 3 so that they may not go into the region of the winding portion 7. However, since forming the coil winding 5 on the bobbin 1 and removing the insulating film from the leaders 10 of the coil winding 5 are automatically carried out by the machines, the winding of the coil winding 5 by the winding machine may be fluctuated, with the result that the bare end portions 12 of the leaders 10 may go into the region of the winding portion 7.

If, in this case, the insulating film of the coil winding 5 wound on the winding portion 7 has pin holes, then short circuits may occur with the coil winding 5; that is, the coil unit may not work correctly.

SUMMARY OF THE INVENTION

The above-described problems have been solved by the provision of a coil unit in which, according to the invention, beside at least one of the flanges, another flange is provided to form an auxiliary winding portion therebetween, and the leader extended from the winding starting or finishing end of the coil is suitably wound on the auxiliary winding portion.

DESCRIPTION OF THE PREFERRED EMBODIMENT

Figure 1:
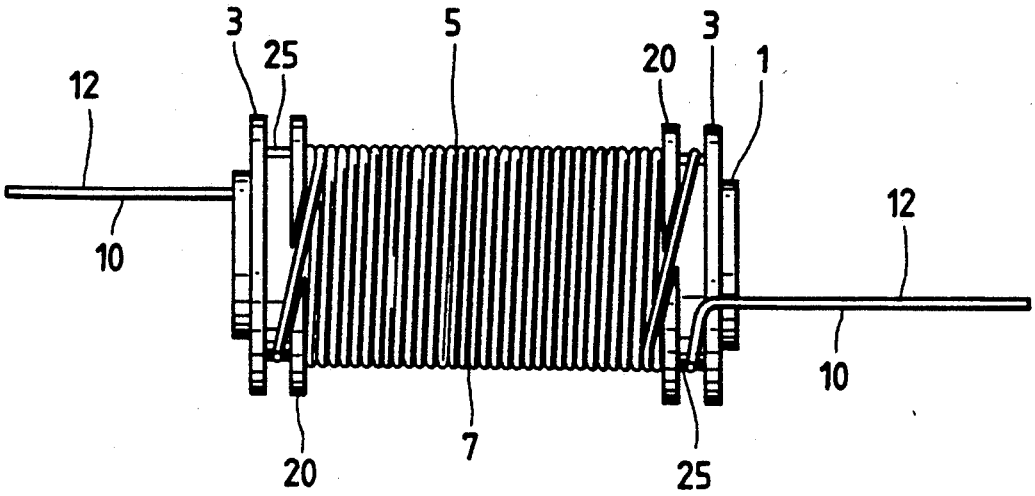
FIG. 1 is a diagram showing a coil unit of an embodiment of this invention.
Figure 2:
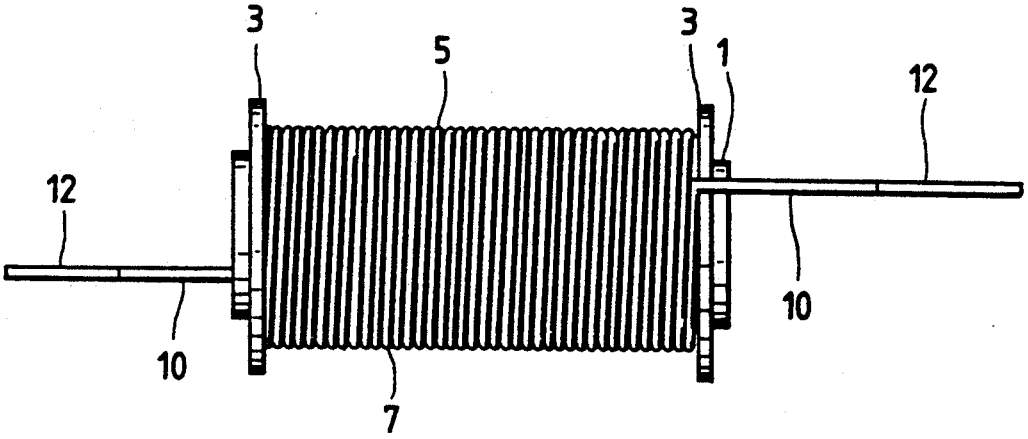
FIG. 2 is a diagram showing a conventional coil unit.

An electrical coil unit, one embodiment of this invention, will be described with reference to FIG. 1. The electrical coil unit is made up of a bobbin 1 of resin or the like. The bobbin 1 comprises: second flanges 20; a first winding portion 7 between those second flanges 20; second winding portions 25 located outside the second flanges 20; and first flanges 3 and 3 outside the second winding portions 25 and 25. Those components are integrally formed as the bobbin 1. The coil winding 5 is, as is conventional, formed from a wire surrounded by insulation. The leaders 10 of the coil winding 5 are formed by end portions of the coil winding, and include the wire.

In the bobbin 1, one of the leaders 10 of the coil winding 5 is passed through one of the first flanges 3, and is then wound on one of the second winding portions 15 for instance ¾ turn, and is then wound on the region of the first winding portion. After the coil winding 5 is wound, another leader 10 is wound on another second winding portion 25 for instance ¾ turn, and is then extended outwardly through the other first flange 3.

Thereafter, the two end portions of the coil winding 5, namely, the leaders 10 wound on the second winding portions 25 are made bare by removing the insulating film therefrom. In this case, the removal of the insulating film can be started from any parts of on the leaders which are in the regions of the second winding portion 25. Accordingly, all the leaders 10 outside the first flanges 3 and 3 can be made bare.

In the coil unit thus formed, the removal of the insulating film from the leaders 10 of the coil winding 5 are started from the parts of the leaders which are located in the regions of the second winding portions 25. Hence, even if the parts of the leaders 10 and 10 which are to be formed into the bare end portions 12 and 12, are more or less shifted when the insulating film is removed therefrom by the automatic winding machine etc., they are prevented from being laid over the coil winding 5 which is covered with the insulating film.

The coil unit thus designed is completely free from the difficulty that the bare end portions 12 go into the region of the winding portion 7 because the winding is fluctuated when the coil is wound by the winding machine or the like. Thus, the coil unit provided is normal in characteristic.

Furthermore, in the coil unit, the leaders 10 outside the flanges 3 are made bare in their entirety by removing the insulating film therefrom. Hence, connection of the leaders to the input and output terminals can be achieved considerably near the coil unit. Thus, for instance when the coil unit is applied to an ignition coil, it can be miniaturized.

What is claimed is:

1. An electrical coil unit including a bobbin made of non-magnetic material, said bobbin comprising:

a primary winding portion defined between two first flanges, on which a coil winding consisting of a wire covered by an insulating film is wound to form a coil and including leaders which consist of portions of said wire and insulating film;

auxiliary winding portions defined between said first flanges and respective second flanges provided outside of said first flanges, on which said leaders extending from a winding starting and a winding finishing end of said coil are wound;

wherein said insulating films of said leaders are stripped to expose portions of said wire, said exposed portions of said wire being uncovered by any material and extending from points on said auxiliary winding portions to said ends of said leaders, said insulating films extending into said auxiliary winding portions to the points where said exposed portions of said wire start.

2. An electrical coil unit as claimed in claim 1, wherein said bobbin is made of resin, and is in the form of a cylinder.

3. An electrical coil unit including a bobbin made of non-magnetic material, said bobbin comprising two first flanges, and a first winding portion extending between said first flanges, on which a coil winding is wound, said coil winding including a wire having an insulated portion and a bare portion, said winding also including a leader consisting of a portion of said wire and insulation, and further comprising:

a second flange provided at an outside of said first flanges to form a second winding portion between said first flange and said second flange, wherein the insulated portion of said leader extends into said second winding portion and the bare portion of said wire extends to a winding end of said coil winding, and wherein said bare portion of said wire is uncovered by any material.

4. An electrical coil unit as claimed in claim 1, wherein said bobbin is made of resin, and is in the form of a rectangular parallelepiped.

5. An electrical coil unit as claimed in claim 3, wherein said winding end of said coil is a winding starting end.

6. An electrical coil unit as claimed in claim 3, wherein said winding end of said coil is a winding finishing end.

* * * * *